US005338022A

United States Patent [19]

Funk et al.

[11] Patent Number: 5,338,022

[45] Date of Patent: Aug. 16, 1994

[54] DEVICE FOR STACKING AND ALIGNING INDIVIDUALLY SUPPLIED SHEETS

[75] Inventors: Helmut Funk, Remshalden; Franz Allmendinger, Eichwald; Markus Weber, Esslingen, all of Fed. Rep. of Germany

[73] Assignee: Eastman Kodak Company, Rochester, N.Y.

[21] Appl. No.: 86,813

[22] Filed: Jul. 2, 1993

[30] Foreign Application Priority Data

Sep. 3, 1992 [DE] Fed. Rep. of Germany ..... 4229425

[51] Int. Cl.[5] ..... B65H 29/22; B65H 31/36

[52] U.S. Cl. ..... 271/184; 271/220; 271/251

[58] Field of Search ..... 271/226, 227, 250, 251, 271/184, 220, 224

[56] References Cited

U.S. PATENT DOCUMENTS

| | | | |
|---|---|---|---|
| 3,854,315 | 12/1974 | Winkler | 271/250 X |
| 4,379,549 | 4/1983 | Mizuma | 271/251 X |
| 5,065,998 | 11/1991 | Salomon | 271/251 |
| 5,084,610 | 1/1992 | Markgraf | 271/250 X |
| 5,088,721 | 2/1992 | Suzuki | 271/251 X |
| 5,199,703 | 4/1993 | Hess | 271/250 X |

FOREIGN PATENT DOCUMENTS

| | | | |
|---|---|---|---|
| 3107768C2 | 7/1985 | Fed. Rep. of Germany | B65H 31/36 |

*Primary Examiner*—Richard A. Schacher
*Attorney, Agent, or Firm*—Lawrence P. Kessler

[57] ABSTRACT

At the free end of a pivotable arm (1) of an aligning device, two wheels (4, 6) of identical diameters are mounted for independent rotary movement, such wheels being driven by a shaft (2). The wheels (4, 6) are each eccentrically offset from the axis of rotation (2*a*) of shaft (2) by the same amount (26, 27)and are uniformly spaced about said axis. With respect to a plane running perpendicularly to the axis of rotation (2*a*) of shaft (2), each wheel (4, 6) is mounted at an acute angle ($\alpha$) such that adjacent wheels (4, 6) are arranged in a V-shaped configuration. The eccentrically (26, 27) and the angular position ($\alpha$) of the wheels (4, 6) are related such that the contact surface (4*b* and 6*b*) of each wheel (4 and 6, respectively) resting on the sheet to be aligned carries out a movement transversely to the sheet-entrance direction (A) and towards the lateral limiting wall (18).

8 Claims, 6 Drawing Sheets

DEVICE FOR STACKING AND ALIGNING INDIVIDUALLY SUPPLIED SHEETS

BACKGROUND OF THE INVENTION

The invention relates in general to a device for aligning sheets individually supplied to a collecting tray in which they are collected one on top of the other in a stack, and in particular, copy sheets which are supplied from a copier and whose collecting tray has a depositing surface and a lateral limiting wall arranged in parallel with the sheet-entrance direction as well as an abutment associated with the front end side of the sheets, a drivable wheel being mounted for rotary motion about a driven shaft on the free end of a pivotable arm and resting on the incoming sheet for aligning such sheet both with the lateral limiting wall and the front abutment.

DE-31 07 768-C2 discloses a sheet aligning device wherein individually supplied sheets are aligned with a front abutment and a lateral limiting element of the collecting tray by means of a roller arranged obliquely to the sheet-entrance direction and resting continuously on the sheet.

SUMMARY OF THE INVENTION

The invention is intended to provide sheet stacking and an aligning device such that a reliable operation is ensured and wear and tear are minimized.

According to the invention, the sheet stacking and aligning device includes:

- at least two wheels of identical diameters mounted on a driven shaft for independent rotary movement and eccentrically offset from the axis of rotation of the shaft by equal amounts,
- the axis of rotation of the wheels uniformly spaced about the axis of rotation of the shaft on a radius corresponding to the amount of eccentricity,
- each wheel mounted at an acute angle relative to a plane extending perpendicularly to the axis of rotation of the shaft such that adjacent wheels each are arranged in a V-shaped position to each other, and
- the eccentricity and the angular position of the wheels related such that the contact surface of the wheel resting on a sheet to be aligned carries out a movement directed transversely at the sheet-entrance direction and towards the lateral limiting wall.

Advantageously, two wheels arranged in a V-shaped configuration are provided and a lifting device which lifts the wheels from the depositing surface of the collecting tray and the sheet stack respectively engages the pivotable arm on the free end of which the wheels are mounted. The wheels are advantageously designed as radial ball bearings whose outer rings are provided with a coating of high static friction. According to a useful modification, the wheels are secured to a bushing mounted on the shaft and having integral journals whose shape defines the eccentric and angular positions of the wheels.

According to another useful modification of the invention, at least one of the outer rings of the radial ball bearings of the wheels is loaded by a spring supported by the shaft such that the outer ring is frictionally driven by said shaft. The advantage is that the wheels can be continuously held in contact with the sheet and transport an incoming sheet first towards the front abutment and subsequently towards the lateral limiting wall.

The advantages attained by the design, arrangement and functioning of the aligning device according to the invention are as follows:

- wear and tear on the individual wheel are minimized because two transport strokes occur during each revolution of the driving shaft so that the time required for the engagement of the wheels can be reduced;
- the wheels are held in engagement only for the period required for aligning a sheet;
- wear and tear on the wheels is uniform because owing to the ball bearing, alternating peripheral areas of the wheels are brought into engagement;
- the wheels run at a low oscillation and noise level, which is achieved by the opposing eccentricities of the wheels and the resultant balancing of weights;
- thanks to the independently rotatable outer ring of the ball bearing of each wheel, the incoming sheets are first transported to the front abutment before they are shifted into contact with the lateral limiting wall; and
- the wheels of the aligning device consist of components of a simple construction part of which are commercially available.

BRIEF DESCRIPTION OF THE DRAWINGS

Further features and advantages can be inferred from the description of an embodiment of the invention illustrated in the drawing in which.

DETAILED DESCRIPTION OF THE INVENTION

Figure 1:
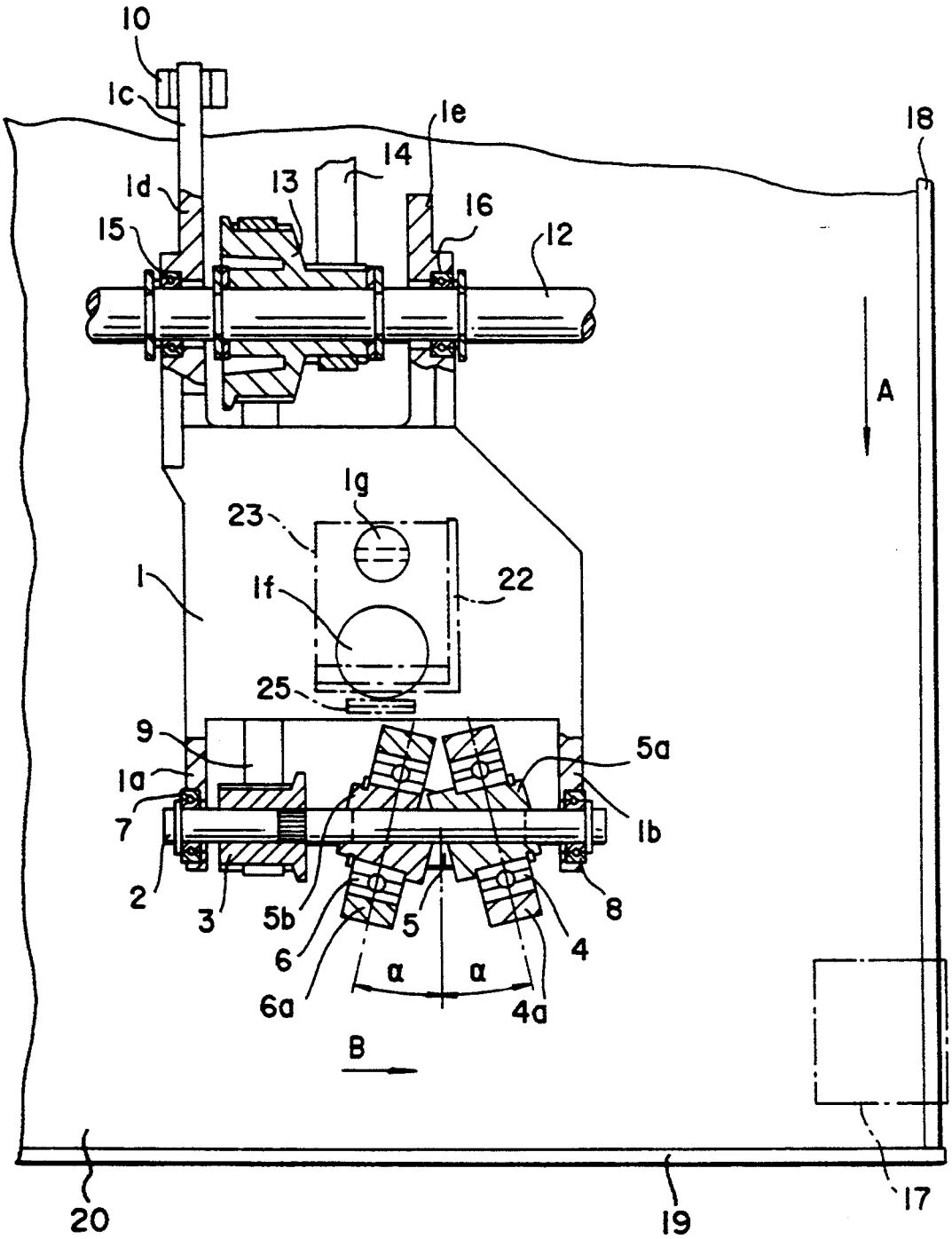
FIG. 1 is a view of the device, partially in section and with the lifting device removed.

The sheet-aligning device according to the invention is provided on a finisher device of a type known per se and not illustrated wherein individually supplied sheets, in particular, copy sheets arriving from a copier, are collected in a collecting tray 20 and stapled in sets by means of a stapling unit 17. Of the finisher device which is connected to a copier (not illustrated), only those components are shown as are necessary to understand the invention.

Sheets arriving in the direction of the arrow "A" enter the collecting tray 20 which is inclined in the sheet-entrance direction and in which they are deposited to form a sheet stack 11. During the feeding operation, the individual sheets are moved into the range of action of an aligning device to be described further below which moves the sheets into contact with a front abutment 19 and a lateral limiting wall 18. The alignment occurs within the range of action of a stapling unit 17 of a type known per se and not illustrated whose position is indicated in dash-dotted lines.

Above the collecting tray 20, an arm 1 is mounted by means of ball bearings 15, 16 for pivotal movement about a shaft 12 and positively held by integrally formed U-shaped webs 1*d*, 1*e*. Shaft 12 is mounted for rotary motion on a cover portion 21 which is arranged above collecting tray 20. Cover portion 21, of which only the free end is shown which is necessary to understand the invention, is pivotably mounted to collecting tray 20 at its end opposite to the direction of the arrow "A", and can be pivoted in the direction of the arrow "C" from a lower operative position, indicated in dash-dotted lines, in which it contacts an abutment (not illustrated) into an upper position.

Between the U-shaped webs 1*d*, 1*e* of arm 1, a first driving wheel 13 is mounted for rotation, such wheel being driven by a first belt 14 and held in engagement with a second belt 9. The second belt 9 drives a second driving wheel 3 which is secured to a rotary shaft 2 mounted on the free end of arm 1. Shaft 2 is also mounted by means of ball bearings 7 and 8 and positively held on outriggers 1*a*, 1*b* of arm 1. Shaft 2 carries a drivable wheel assembly which includes bushing 5 on which a first and a second wheel 4 and 6 respectively are arranged. The wheels 4 and 6 are designed as radial ball bearings whose inner rings are fixed to a journal 5*a* and 5*b* respectively of bushing 5. Each circumference of the outer rings of wheels 4 and 6 is provided with a coating 4*a* and 6*a* respectively of high static friction (high coefficient of friction). The two wheels 4 and 6 have identical diameters.

Figure 3:
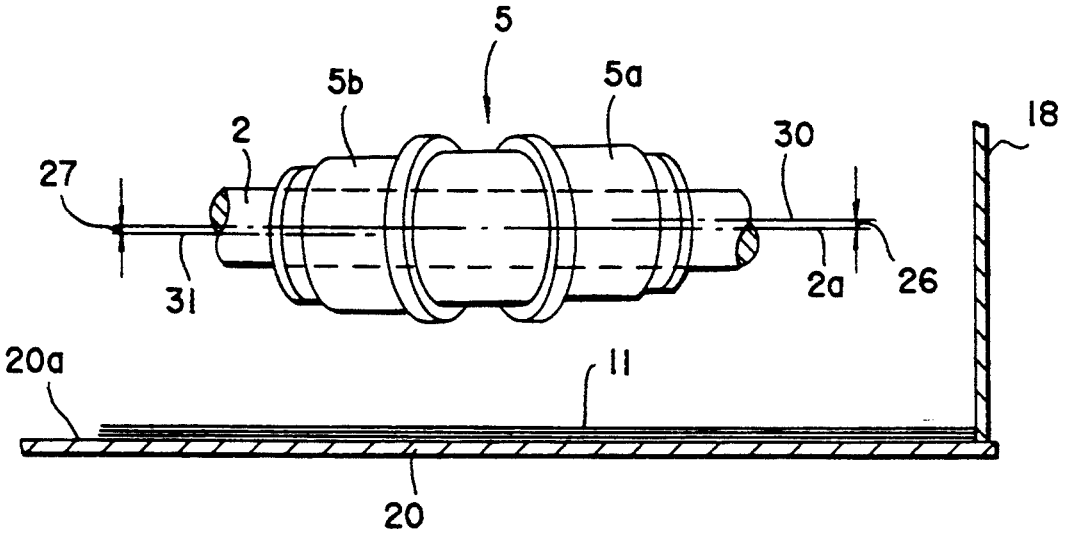
FIG. 3 is a front view of the bushing of the device according to FIG. 1.
Figure 4:
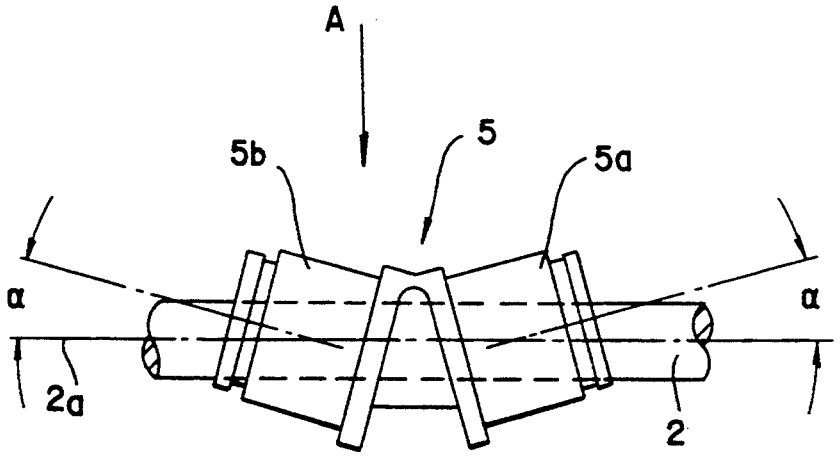
FIG. 4 is a view from above of the bushing according to FIG. 3.

Bushing 5 which is shown in particular in FIGS. 1,3 and 4 has two journals 5*a* and 5*b* which are eccentrically arranged with respect to shaft 2. As illustrated, in particular in FIGS. 1 and 4, the journals 5*a* and 5*b* are obliquely arranged at an acute angle $\alpha$ with respect to the axis of rotation 2*a* of shaft 2 so that the wheels 4 and 6 seated on them are disposed in a V-shaped angular position to each other as is illustrated in FIG. 1.

The eccentric arrangement of the wheels 4 and 6 will now be described with reference to FIG. 1 in which they are shown in a V-shaped configuration at an angle which is open towards the front abutment 19. As can be inferred from the illustration of the bushing 5 in FIG. 3 which corresponds to that V-shaped angular position, journal 5*a* is eccentrically offset from the axis of rotation 2*a* of shaft 2 by a distance 26 whereas journal 5*b* is eccentrically offset by an equal distance 27 in the opposite direction. The eccentric displacement of journal 5*a* associated with wheel 4 is remote from the depositing surface 20*a* of collecting tray 20 by the distance 26 while the eccentric displacement of journal 5*b* associated with wheel 6 is closer to the depositing surface 20*a* by the same distance 27. The eccentric displacement of the wheels 4 and 6 by the distance 26 and 27 respectively is, for example, 0.35 mm when measured vertically to the depositing surface 20*a* of collecting tray 20 whereas the angle $\alpha$ at which each of the journals 5*a* and 5*b* is skewed is, for example, 13.5° .

A low-bias spring (not illustrated) which engages arm 1 and is supported by cover portion 21, urges arm 1 counterclockwise. The front abutment 19 of collecting tray 20 is mounted for pivotal movement about a journal 19*a* and movable in the direction of the arrow "D" by an electromagnet (not illustrated). An electromagnet 23 positioned above arm 1 is attached to the upper side of cover portion 21 by means of a holder 22 (see FIG. 2). The armature 23*a* of electromagnet 23, which is movable substantially perpendicularly to the depositing surface 20*a* of collecting tray 20 in the direction of the arrow "F", is hingedly connected to a projection 1*g* of arm 1 by means of a rod 24.

Figure 2:
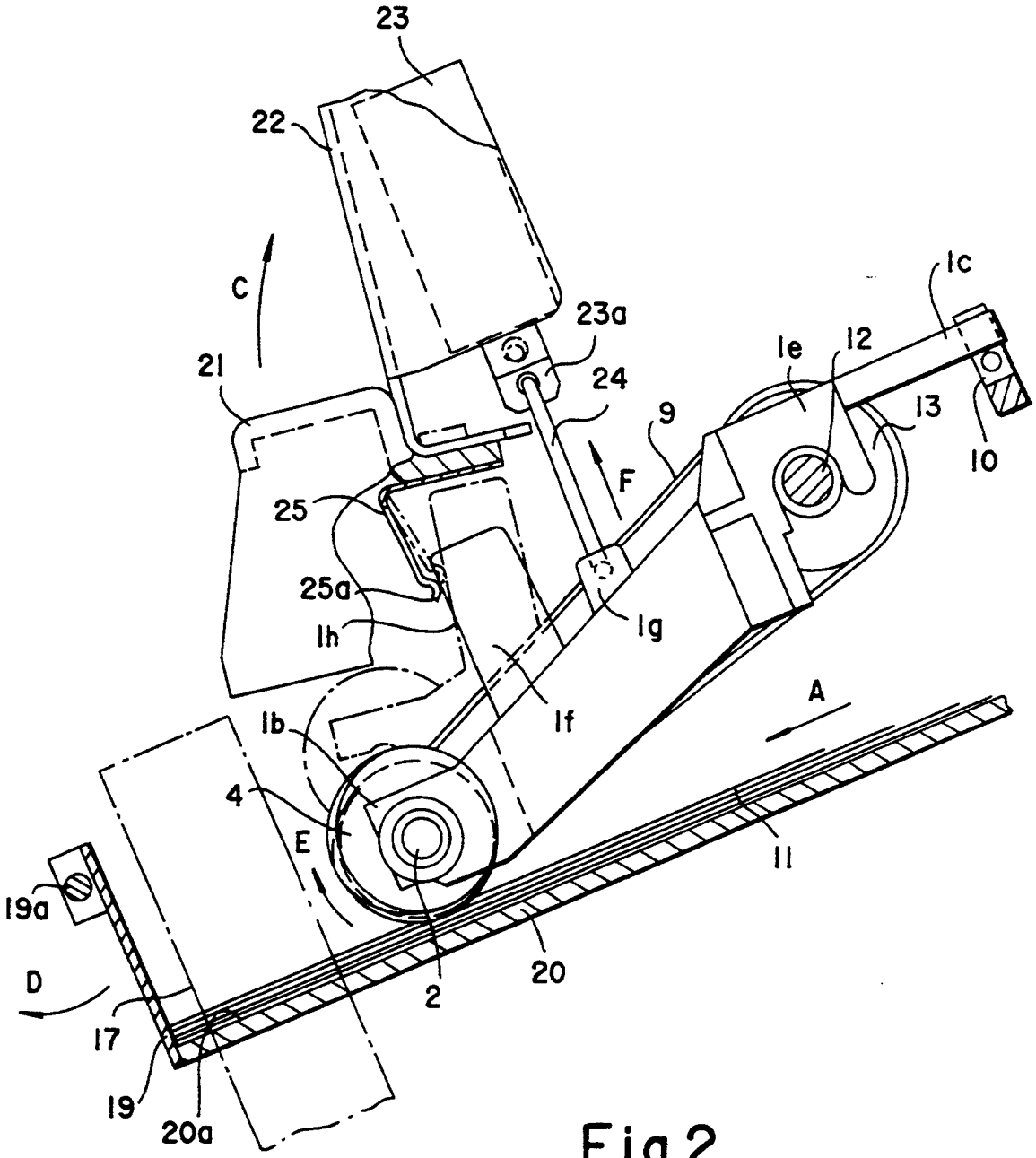
FIG. 2 is a lateral view of the device according to FIG. 1 including the lifting device.

Mounted to the lower side of cover portion 21 is a braking spring 25, one spring arm 25*a* of which is held in frictional engagement with a projection 1*f* of arm 1. Projection 1*f*, which is arranged on the upper side of arm 1, is located in the area of arm 1 associated with the wheels 4 and 6. The area 1 *h* of projection 1*f*, which faces the wheels 4 and 6, is straight and long enough for spring arm 25*a* of braking spring 25 to be held in frictional contact with it in any angular position of arm 1. As can be seen in FIG. 2, the position of area 1 *h*, and thus the distance between the point of contact of spring arm 25*a* and the axis of rotation of shaft 12, changes depending on the pivotal position of arm 1. Consequently, the spring urging of braking spring 25 increases when arm 1 is lowered from its lifted position indicated in dash-dotted lines to its operative position illustrated in FIG. 1 whereby such arm has more and more force applied thereto when the braking action increases.

The device functions as follows:

When the finisher device is switched on, electromagnet 23 is energized whose armature 23*a* pulls rod 24 in the direction of the arrow "F" and thereby moves arm 1 along with the wheels 4 and 6 into the position shown in dash-dotted lines in FIG. 2. The continuously driven wheels 4 and 6 are thus located in a lifted position above the maximum height of a sheet stack 11, which is defined by a stationary journal of cover portion 21, and sheets entering the depositing tray in the direction of the arrow "A+ under the action of gravity can also slide without any obstruction into contact with the front abutment 19.

The path of movement of a sheet entering in the direction of the arrow "A" includes a sensor (not illustrated) which senses the leading edge of the sheet and actuates a control device of a type known per se and not illustrated which after a predetermined interval switches off electromagnet 23 to allow arm 1 to drop. During the dropping movement of arm 1, electromagnet 23 is temporarily energized by the control device so that the dropping movement is braked before the wheels 4 and 6 make contact with sheets already deposited. The point of contact of the wheels 4 and 6 is chosen such that the incoming sheet arrives with the wheels 4 and 6 already resting on it.

During the lowering movement, the electromagnetically influenced braking operation is further enhanced by braking spring 25, 25*a*. As mentioned before, the continuously operative braking spring 25 acts on area 1*h*, with its braking action increasing so that the wheels 4 and 6 are brought into engagement with the sheets at low speed. This prevents a sheet to be aligned from rebounding when the wheels 4 and 6 come to rest on it with high impact and excludes resultant functional disturbances during the aligning operation while allowing the wheels 4 and 6 to function properly as soon as they contact the sheet to be aligned. Moreover, braking spring 25 attenuates oscillations occurring in the arm 1 during the aligning operation.

The actual aligning operation takes place as follows:

Since the wheels 4 and 6 are continuously driven in the direction of the arrow "E", the outer rings of the ball bearings of wheels 4 and 6 are set in motion by frictional engagement such that they also rotate in the same direction. The movement caused by such frictional engagement is enhanced by the centrifugal force resulting from the oblique position of the wheels 4 and 6 so that the outer rings of the ball bearings are reliably driven. When arm 1 is lowered, one of the wheels 4 or 6 first makes contact with the sheet to be aligned. The outer ring set in motion engages the sheet with its coating 4*a* and 6*a* respectively for transport in the direction of the arrow "A" and into contact with the front abutment 19. Such transport movement can be continued by the other of the wheels 6 or 4 depending on the rotary position of the wheels 4 and 6 and on whether or not the sheet has arrived at the front abutment 19.

However, as soon as the sheet has arrived at the front abutment 19, the outer rings of wheels 4 and 6, which are driven by frictional engagement only, are prevented from further rotation and arrested. Shaft 2 which continues being driven rotates bushing 5 in the direction of arrow "E". This causes the inner rings of the ball bearings to rotate while the outer rings rest on the sheet to be aligned with their coating 4*a* and 6*a* respectively and do not rotate. As a result of their eccentric mounting, the wheels 4 and 6 are alternately brought into engagement with the sheet to be aligned, and owing to their V-shaped arrangement at an acute angle, they carry out a tumbling rotary movement whose influence on the sheet to be aligned will be described with reference to FIGS. 5 to 17.

For better understanding of the device, the sequences of motion are schematically illustrated in FIGS. 5 to 17 in which the eccentricities of the wheels 4 and 6 are exaggerated. Also, for better understanding, FIGS. 5 to 17 show views from below, i.e., from an assumed position of a person looking at each of the contacting wheels 4 or 6 through a glass plate from below.

Figure 5:
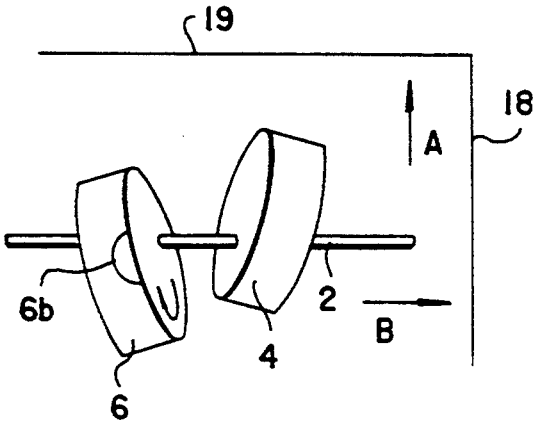
FIG. 5 to 10 show the sequence of motions of one of the wheels of the device according to FIG. 1 as seen from below.
Figure 8:
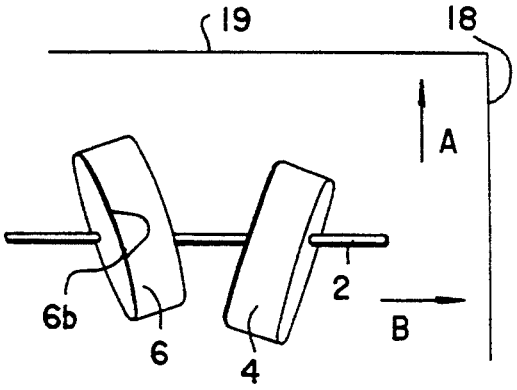
Figure 6:
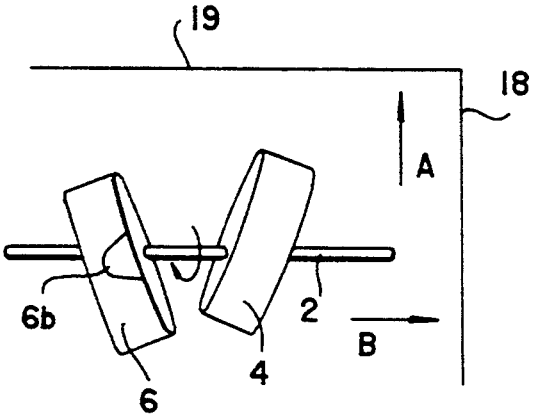
Figure 9:
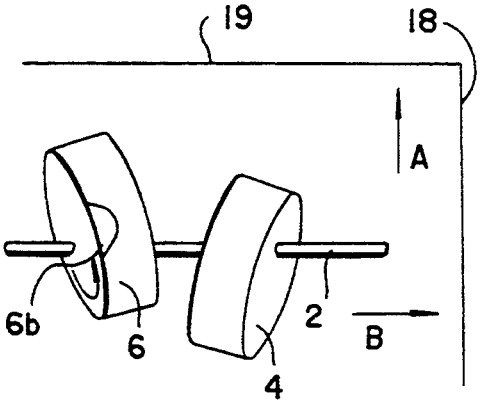
Figure 7:
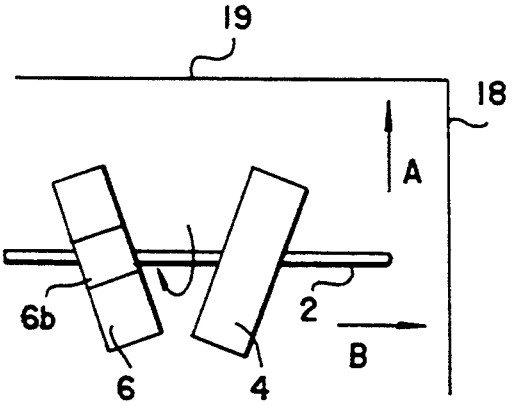
Figure 10:
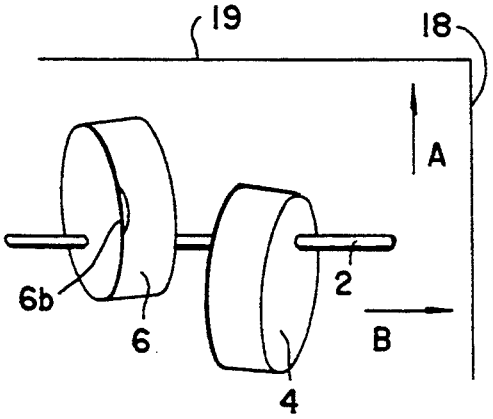

Owing to their opposing eccentricities wheels 4 and 6 are successively brought into engagement during each revolution of shaft 2 so that the sheet to be aligned is transported twice during one revolution of shaft 2 to move in the direction of the arrow "B" towards the lateral limiting wall 18. At the beginning of the first transport movement, as shown in FIG. 5, wheel 6 acts on the sheet to be aligned. Owing to the cylindrical peripheral surface of the resilient coating 4*a* and 6*a* respectively, the contact surface 6*b*, indicated in the drawing, changes its position and shape in the manner illustrated in the Figs.

Figure 11:
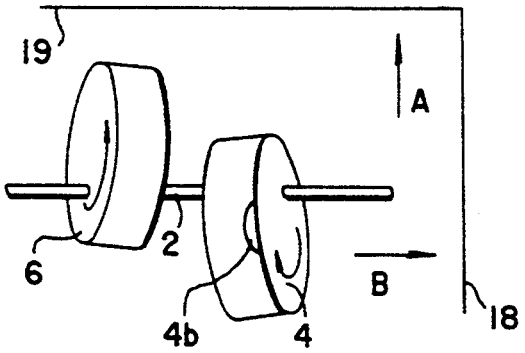
FIGS. 11 to 17 show the sequence of motions of the other wheel of the device according to FIG. 1 as seen from below.
Figure 15:
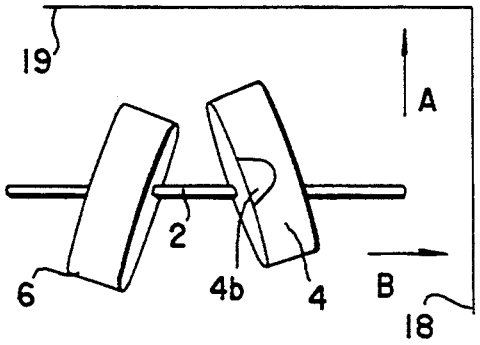
Figure 12:
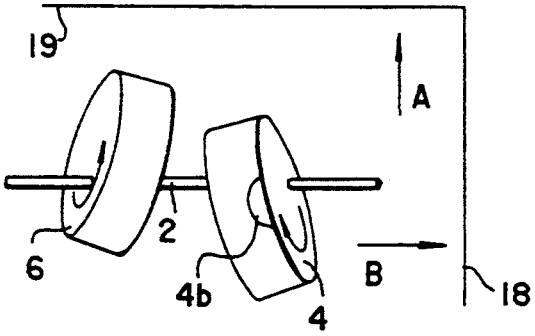
Figure 16:
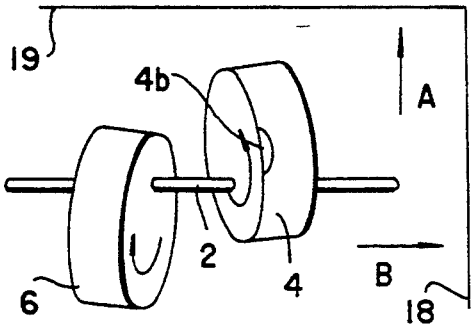
Figure 13:
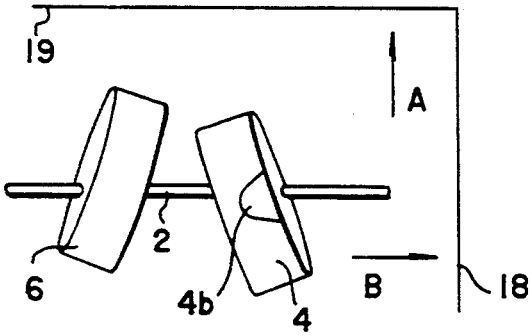
Figure 17:
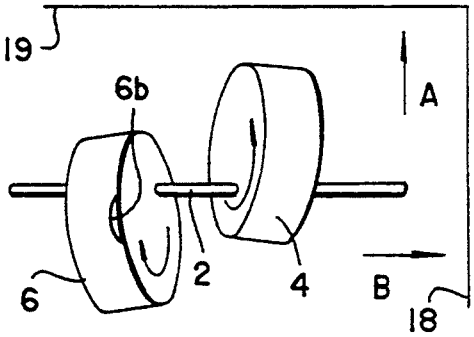
Figure 14:
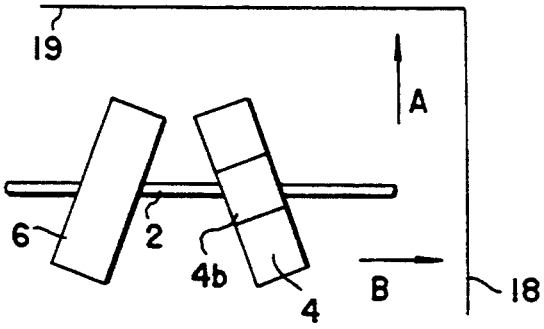

As can be inferred from FIGS. 5 to 10, the contact surface 6*b* of wheel 6 travels gradually towards the lateral limiting wall 18 owing to the oblique position of wheel 6 and thus shifts the sheet laterally in the direction of the arrow "B". After about half a revolution of shaft 2, wheel 6 is lifted from the sheet while the other wheel 4 makes contact with the sheet. This situation is shown in FIG. 11. Starting from the position according to FIG. 11, the contact surface 4*b* of wheel 4 also moves gradually towards the lateral limiting wall 18 as shown in FIGS. 11 to 16, owing to the oblique position of wheel 4, and the sheet to be aligned carries out its second transport movement in the direction of the arrow "B". Upon completion of one revolution of shaft 2, wheel 4 is lifted from the sheet while wheel 6 makes once again contact with the sheet to be aligned, as is shown in FIG. 17. The operation of the wheel 6 and 4 respectively is repeated when shaft 2 carries out another revolution. During one revolution of shaft 2, the sheet to be aligned is transported twice by about five millimeters, i.e., altogether by about ten millimeters, in the direction of the arrow "B". This transport distance results from the angular position $\alpha$ of 13.5° and a diameter of 25 mm of each of the wheels 4 and 6.

Figure 18:
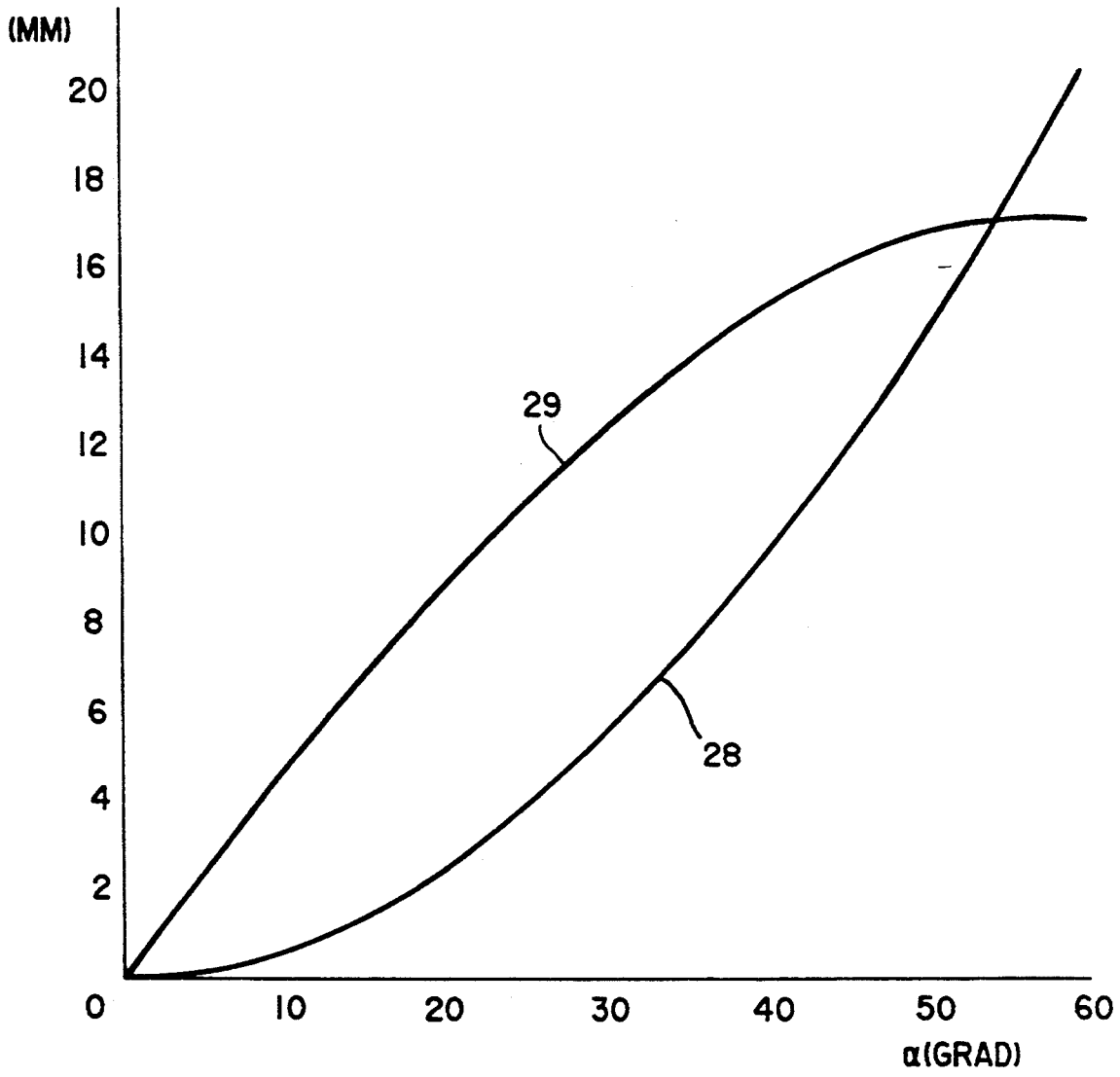
FIG. 18 is a graph illustrating the relation between the angular position of a wheel and the sheet transport.

With reference to a graph shown in FIG. 18, the relation between the oblique position $\alpha$ of wheel 4 and 6 respectively and the sheet advance attainable both in the direction of the arrow "A" (curve 28) towards the front abutment 19 and in the direction of the arrow "B" (curve 29) towards the lateral limiting wall 18 will now be explained. The graph is based on the following values:

| | |
|---|---|
| Radius of the wheel | 12.5 mm |
| Width of the wheel | 3.0 mm |
| Eccentricity | 0.5 mm |

The graph reveals that in the case of a small angle $\alpha$ of say 13.5° according to the embodiment the advance in the direction of the arrow "A" (curve 28) is too small to align the sheet with the front abutment 19 before it has been brought into contact with the lateral limiting wall 18. However, the small angle according to the embodiment reduces the motions of arm 1 so that the oscillations of the wheels 4 and 6 are minimized. In order to benefit from this advantage, transport in the direction towards the front abutment 19 is effected in the manner already described using the outer ring set in motion of the ball bearing of wheel 4 and 6 respectively. The sheets can thus be aligned with the front abutment 19 before they are transported to the lateral limiting wall 18, and sheets are prevented from leaving their plane alignment position and sliding obliquely upwards at the lateral limiting wall 18. Moreover, the wheels 4 and 6 are so close to the front abutment 19 and the lateral limiting wall 18 respectively that the sheets' inherent stiffness prevents aligned sheets from escaping from their plane alignment position.

After a predetermined number or length of aligning pulses in the direction of the arrow "B" as set by the control device, electromagnet 23 is energized to lift arm 1 and thus the wheels 4 and 6 from the aligned sheet. The wheels 4 and 6 are thus held in engagement only as long as is necessary to align a sheet, and unnecessary wear and tear in particular of the friction coating 4*a* and 6*a* respectively of the wheels 4 and 6 is avoided. The sheets reliably deposited and aligned in this manner can subsequently be stapled by stapling unit 17 to form a compact set. When the front abutment 19 is opened in the direction of the arrow "D", the stapled sheet stack 11 can move into a depositing tray attached to the apparatus and not illustrated.

In order that the accumulated height of the sheet stack 11 does not exceed the stack height which the stapling unit 17 can handle, a device is provided for limiting the stack height. The device includes a stationary forked light barrier 10 adapted to receive a flag 1*c* integral with arm 1 of the aligning device. As soon as the maximum stack height has been reached, flag 1*c* cover light barrier 10, which interrupts the sheet supply. Since flag 1*c* is integral with arm 1, the stack height can be measured in an advantageous manner by the aligning device resting under the action of gravity on the compressed sheet stack 11 so that measurement occurs under the conditions required for assessing whether the sheets have been properly stapled.

In contrast to the embodiment described, a different angular position $\alpha$ of the wheels 4 and 6 can also be chosen if, for example, a greater transport stroke in the direction of the arrow "A" towards the front abutment 19 is to be reached at the same time. As shown by the graph in FIG. 18, a wheel arranged in an angular position $\alpha$ of 45° can be advanced in the direction of the arrow "A" (curve 28) by about 12 mm, its advance in the direction of the arrow "B" (curve 29) then being about 16 mm.

For reasons of an inexpensive manufacture, the wheels according to the embodiment are provided with a coating 4*a* and 4b respectively which has a cylindrical peripheral surface. In contrast to the embodiment, the coating 4*a* and 4*b* can also be provided with an arched surface, which allows the eccentricity to be reduced to about 0.2 mm and generally makes for smoother motions of the wheels 4 and 6.

The aligning device may also be provided with more than two wheels (not illustrated). In such a case, each of the wheels is eccentrically offset from the axis of rotation 2*a* by the same amount and the wheels are equally spaced about said axis. The total advance stroke applied in the direction of the arrow "B" is divided among the number of wheels. The device according to the invention can also be advantageously used in the absence of a lifting device for arm 1, i.e., if the wheels 4 and 6 rest continuously on sheet stack 11. In a device adapted for that purpose at least one of the outer rings of the ball bearings of wheels 4 and 6 respectively is frictionally influenced (not illustrated) such that a frictional engagement by shaft 2 is made possible. The frictional forces are adjusted such that wheels 4 and 6 respectively transport an incoming sheet in the direction of the arrow "A" up to the front abutment 19. As soon as the sheet contact abutment 19, the friction is overcome so that the outer ring is arrested. Via bushing 5 which continues rotating the wheels 4 and 6 are moved in the manner described and the sheet is thus transported in the direction of the arrow "B" towards the lateral limiting wall 18. The friction means may be designed such (not illustrated) that between the outrigger 1*b* of arm I and the wheel 4, a pressure spring supported by shaft 2 is arranged which influences a disk resting on the outer ring of the ball bearing of wheel 4. Analogously designed friction means can also influence the other wheel 6.

The invention has been described in detail with particular reference to preferred embodiments thereof, but it will be understood that variations and modifications can be effected within the spirit and scope of the invention as set forth in the claims.

What is claimed is:

1. Device for aligning sheets individually supplied to a collecting tray in which they are collected one on top of the other in a stack, in particular, copy sheets which are supplied from a copier and whose collecting tray has a depositing surface and a lateral limiting wall arranged in parallel with the sheet-entrance direction as well as an abutment associated with the front end side of the sheets, a drivable wheel assembly being mounted for rotary motion about a driven shaft at the free end of a pivotable arm and resting on the incoming sheet for aligning said sheet both with the lateral limiting wall and the front abutment, wherein said drivable wheel assembly includes at least two wheels (4, 6) of identical diameters are mounted on said driven shaft (2) for independent rotary movement and eccentrically offset from the axis of rotation (2*a*) of said driven shaft (2) by an equal amount (26 and 27, respectively);

the axes of rotation (30, 31) of said wheels (4, 6) are uniformly spaced about the axis of rotation (2*a*) of said driven shaft (2) on a radius corresponding to the amount (26 and 27, respectively) of the eccentricity;

each of said wheels (4, 6) is mounted at an acute angle (a) relative to a plane extending perpendicularly to the axis of rotation (2*a*) of said driven shaft (2) such that adjacent wheels (4, 6) each are arranged in a V-shaped position to each other; and the eccentricities (26, 27) and the angular position (a) of said wheels (4, 6) are related such that the contact surface (4*b* and 6*b*, respectively) of each wheel (4 and 6, respectively) resting on a sheet to be aligned carries out a movement directed transversely to the sheet-entrance direction (A) and towards the lateral limiting wall (18).

2. The sheet aligning device according to claim 1, wherein said driven shaft (2) carries a bushing (5) with integral journals (5*a*, 5*b*) on which said wheels (4, 6) are arranged, said wheels taking the form of radial ball bearings;

the inner rings of the radial ball bearings of said wheels (4 and 6, respectively) are frictionally connected with the journals (5*a* and 5*b*, respectively); and the said journals (5*a* and 5*b*, respectively) determine the eccentric and angular positions of said wheels (4 and 6, respectively).

3. The sheet aligning device according to claim 2, wherein the outer rings of the radial ball bearings of said wheels (4 and 6, respectively) are each provided with a coating (4*a* and 6*a*, respectively) of high static friction.

4. The sheet aligning device according to claim 2, wherein said wheels (4 and 6, respectively) are arranged side by side in the area of said driven shaft (2) adjacent to said lateral limiting wall (18) and in that the drive (3) of said driven shaft (2) is operative in the area of said driven shaft (2) remote from said lateral limiting wall (18).

5. The sheet aligning device according to claim 4, wherein two wheels (4, 6) are provided which are arranged relative to the sheet entrance direction (A) such that they are disposed in a V-shaped configuration at an acute angle ($\alpha$) which is open in the sheet-entrance direction (A) towards said front abutment (19);

that the axis of rotation (30) of one wheel (4), which faces the lateral limiting wall (18), is eccentrically offset from the axis of rotation (2*a*) of said driven shaft (2) by a distance (26) further remote from said depositing surface (20*a*); and that the axis of rotation (31 ) of the other wheel (6) is eccentrically offset from the axis of rotation (2*a*) of said driver shaft (2) by an equal distance (27) oppositely to said one wheel (4) and more closely to said depositing surface (20*a*).

6. The sheet aligning device according to claim 5, wherein a lifting device (23) engages said pivotable arm (1), said lifting device lifting the wheels (4, 6) from said depositing surface (20*a*) of said collecting tray (20) and the sheet stack (11) respectively;

said lifting device (23) is controllable such that when a sheet arrives, said wheels (4, 6) are movable from a lifted position to a lowered position in which they rest on the incoming sheet; and said lifting device (23) lifts said wheels (4, 6) from the aligned sheet after a predetermined number or period of aligning operations.

7. The sheet aligning device according to claim 6, wherein said lifting device is designed as a stationarily mounted electromagnet (23) which is effective in a direction substantially perpendicular to the depositing surface (20*a*) of said collecting tray (20);

said electromagnet (23) engages that side of said arm (1) which is remote from the depositing surface (20*a*) of said collecting tray (20); and the armature (23*a*) of said electromagnet (23) is hingedly connected to said arm (1) via a rod (24).

8. The sheet aligning device according to claim 5, wherein at least one of the outer rings of the radial ball bearings of said wheels (4 and 6, respectively) is frictionally drivable by a spring supported by said driven shaft (2).

* * * * *